US005184372A

United States Patent [19]

Mache

[11] Patent Number: 5,184,372

[45] Date of Patent: Feb. 9, 1993

[54] VACUUM ASSISTED SQUEEGEE ATTACHMENT

[76] Inventor: Gerhard R. Mache, 284 Ascot La., Streamwood, Ill. 60107

[21] Appl. No.: 638,433

[22] Filed: Jan. 7, 1991

[51] Int. Cl.[5] ..... A47L 9/06

[52] U.S. Cl. ..... 15/401; 15/245

[58] Field of Search ..... 15/401, 245

[56] References Cited

U.S. PATENT DOCUMENTS

| | | | |
|---|---|---|---|
| 2,793,384 | 5/1957 | Ortega | 15/401 X |
| 3,069,716 | 12/1962 | Smith | 15/401 X |
| 3,210,792 | 10/1965 | Sassano | 15/401 |
| 3,571,841 | 3/1971 | Crouser | 15/401 |
| 3,584,330 | 6/1971 | Wallin et al. | 15/401 X |
| 4,864,681 | 9/1989 | Hult et al. | 15/401 X |

*Primary Examiner*—Chris K. Moore

*Attorney, Agent, or Firm*—Charles F. Meroni, Jr.

[57] ABSTRACT

A squeegee attachment tool for use with a wet/dry vacuum cleaner incorporating an oblong but narrow in profile suction head fitted with a very short squeegee blade providing both high suction and superior aspiration and yet reaches to the extreme edges of a cleaned surface at both the beginning and end of a cleaning stroke. Internal angled ribs coupled with an efficient vacuum chamber a narrow but deep intake port throat with side channel creates improved pressure distribution at the intake port mouth and provides significant side suction to remove liquid and debris from along and beneath adjacent surfaces and other obstructions. Specifically dimensioned and angled handle improves operator comfort and effectiveness.

21 Claims, 4 Drawing Sheets

VACUUM ASSISTED SQUEEGEE ATTACHMENT

BACKGROUND OF THE INVENTION

The invention relates to a squeegee attachment or device for use with a vacuum producing means capable of wet pick up such as wet/dry vacuum cleaners.

The technology and application of a vacuum to squeegees of various formats and configurations and the theoretical benefits of removing both liquid and debris from a surface being cleaned are now well known. Among the minimum working requirements for such a tool are a vacuum source for aspirating both air and liquids, a housing connectable to the vacuum source at one end with an oblong suction head fitted with a narrowed intake port for increasing suction pressure at the other end and a resilient rubber or rubber like squeegee blade in proximity to the intake port. In operation such a tool is wiped across a surface being cleaned which has been previously wetted with a cleaning solution drawing liquid and foreign debris toward the intake port as the vacuum source aspirates the material.

Thus in operation, theoretical benefits arise to the user including the relatively easy removal of liquids and foreign matter from the surface over which the tool rides and the relatively quick and convenient accomplishment of the task at hand. However, most surfaces to be cleaned in this manner have an obstructing border along its periphery such as the wood frame supporting window glass and the adjacent walls defining a floor. These obstructing borders have not been adequately addressed in the past. Additionally, proper suction pressure distribution and appropriate tool dimensioning and design have been lacking.

The promised benefits of efficiency, convenience and cost have not been fully realized. Though some devices may be adequate for bulk removal of liquids, they fall short of the intended purpose and leave a considerable quantity of liquid, debris and cleaning solution on or adjacent to the surfaces they are intended to clean. This can be easily observed along the edges of a surface being cleaned and indeed with most devices even on the primary cleaned surface.

Deficiencies of devices to date can be traced to a number of inherent problems including but not limited to the following: Large, bulky and/or clumsy suction heads. Various protrusions and encumbrances near or on the suction head. Long squeegee blades and poor attack angles. Inefficient intake port designs including size and various blockages. Ineffective vacuum chambers with dead air spaces. Lack of air flow control and pressure distribution. Attempts to make the tool work in both a push and pull direction. Inappropriate handle height and angles. Multiplicity of parts, chambers and fastening means complicating the tool and increasing costs. And, some devices are mere adapters to other vacuum cleaner tools resulting in significant compromises.

Among other problems, the exhibited deficiencies limit the ability to these devices to pick up the liquids and debris from the surface they were intended to clean. Current devices have insufficient and uneven suction pressure at the intake port mouth and squeegee blade tip, especially towards the blade's outer ends, and lack adequate side suction. Available devices retain liquids on the squeegee blades and drip them back onto cleaned areas when lifted from the cleaning surface. Current devices do not fully reach into and clean bordered edges and corners. Additionally available devices make it difficult or inconvenient for the operator to accomplish the given task and increase manufacturing complexity and costs.

Examples of these conditions and inadequacies can be seen in the following listed U.S. patents.

SQUEEGEE RELATED U.S. Pat. DOCUMENTS

| U.S. Pat. Nos. | Issue Date | Patentee |
|---|---|---|
| No. 1,057,253 | 3/19/13 | Matchette |
| No. 3,079,623 | 6/1959 | Congdon |
| No. 3,107,387 | 2/1962 | Katt |
| No. 3,584,330 | 6/1971 | Wallin |
| No. 2,893,046 | 2/1954 | Thompson |
| No. 2,793,384 | 11/1952 | Ortega |
| No. 2,793,385 | 11/1952 | Ortega |
| No. 4,475,265 | 10/1984 | Berfield |
| No. 4,557,013 | 12/1985 | Belmont |

SUMMARY OF THE INVENTION

It is therefore the principal object of this invention to provide a new and novel vacuum assisted squeegee attachment tool correcting and overcoming a variety of problems including previously mentioned difficulties and which tool can be produced at a low cost.

It is a further object of this invention to provide a vacuum assisted squeegee attachment tool with a specifically dimensioned suction head which will conveniently fit into framed edges and corners of a typical surface to be cleaned at both the beginning and end of a cleaning stroke.

Another object of this invention is to provide a vacuum assisted squeegee attachment tool with a very short squeegee blade which will nonetheless reach to the extreme framed edges of a surface to be cleaned.

Still another object of this invention is to provide a vacuum assisted squeegee attachment tool with a narrow high efficiency intake port thus enabling improved suction, the tool having side channels to increase sideways air and liquid suction.

Yet a further object of this invention is to provide a vacuum assisted squeegee attachment tool with internal ribs and/or baffles to control, direct and improve suction pressure distribution at the intake port mouth.

An additional object of this invention is to provide a vacuum assisted squeegee attachment tool with an improved vacuum chamber to eliminate dead air spaces therein.

Another object of this invention is to provide a new and improved configuration for a vacuum assisted squeegee attachment tool with the tool having a handle which is positioned in relation to the cleaning surface while the squeegee blade is at its preferred angle of attack providing operator comfort and efficiency during use.

Yet an additional object of this invention is to provide a vacuum assisted squeegee attachment tool which eliminates the need for secondary fastening means such as screws or other fasteners to hold individual parts together.

My new and improved tool is useful on all types of planer surfaces such as hard smooth surfaces including glass windows and uneven non-planer or porous surfaces such as wood floors. In use, my new tool effectively removes liquid and debris from some non-continuous and non-planer surfaces such as adjacent window frames including radii found therein and from beneath adjacent obstacles such as a floor molding. The new tool can conveniently reach into and clean to the extreme bordered edges such as found on windows at both the beginning and end of cleaning stroke and can even squeegee the frame itself.

The primary operation of my improved vacuum assisted squeegee attachment tool is in a pull direction from the blade backwards, towards the handle, and the tool can be used by being hand held and also with an extension wand. The current device is highly effective over a very wide range of squeegee blade attack angles, however, a preferred initial attack angle has been discovered for optimum blade wiping action and minimal applied pressure. Additionally, a preferred set of operator wrist angles has been discovered for a tool of this nature for optimum comfort and efficiency.

According to the invention the vacuum assisted squeegee attachment tool embodies three pieces: a main body, a cover and a resilient, flexible, nonabsorbent rubber or rubber-like squeegee blade. The cover attaches and locks to the main body using simple slots and tabs and with a vacuum seal provided because of the snug fit between the cover and the body. The cover defines the upper wall of a vacuum chamber, the top of the oblong but narrow in profile suction head, and together with the squeegee blade, the upper wall of a throat and intake port. The cover is stepped near its forward edge and therein contains a lateral retaining rib forming a channel. Matching the profile and fitting into the cover, the squeegee blade is set parallel to and runs the length of the cover, suction head and intake port. The cover extends somewhat past the retaining rib and over the squeegee blade providing additional support for the blade while the tool is in use. Saw teeth projections within each end of the cover's channel bite into the squeegee blade preventing lateral slippage. Thus the blade is retained in a fixed position between the cover and a plurality of standoff ribs and pads integral with the bottom wall of the intake port. When the cover is released, the squeegee blade is easily replaceable.

Extending from and at essentially the same height as the intake port mouth and continuing behind the squeegee blade is a relatively long intake port throat defined by the squeegee blade, the cover, main body bottom wall and side/back walls. This long intake port throat creates a transition area between the vacuum chamber and intake port mouth promoting pressure equalization along the lateral width of the intake port mouth without restricting total air flow.

Behind and in direct communication with the extended intake port throat resides a vacuum chamber formed by the cover, handle entrance port and adjacent main body lower and side/back walls. The side/back walls are stepped towards their upper edge forming a vacuum seal with the similarly stepped cover. The side/back walls in combination with the end pads within the intake port, run in an essentially straight line or alternatively in an arc being convex into the vacuum chamber from the hollow handle out to approximately the outer most point of the suction head. Thus, my tool is provided an unobstructed efficient straight or convexly curved transitional air flow path devoid of dead air spaces within the vacuum chamber and intake port.

Behind and in direct communication with the vacuum chamber and attached to the main body bottom and side/back walls resides a hollow handle with a rear exit port suitably fitted to accommodate standard connections to a wet/dry vacuum cleaner intake hose or extension wands. Thus the handle, vacuum chamber, intake port throat intake port and squeegee blade have direct communication with a vacuum source.

The handle has a longitudinal center line that is set at predetermined angles in relation to the plane of the cleaning surface and consequently the squeegee blade for hand held models. This handle/blade angle is set such that when the operator's hand/wrist is in its natural angles the blade is at the preferred angle of attack to the cleaning surface and while the blade is at this preferred angle the handle encourages the operator's hand/wrist to be at natural angles. Thus, my new tool promotes efficient and comfortable hand-wrist-arm movement throughout a cleaning stroke without additional stabilizing means required.

The mouth of the intake port is defined by the underside of the squeegee blade and bottom wall of the main body, both are set parallel to the cover. Integrally molded on the top surface of the bottom wall just inside its leading edge are a plurality of flat topped angled ribs, end pads and an optional middle pad or pads. These ribs and pads support the squeegee blade and cover above the intake port bottom wall defining the intake port mouth and throat height within specific dimensions. Further these ribs and pads direct and control suction pressure along the intake port mouth. Thus is formed a wide laterally but narrow in height intake port slot.

The ribs and pads can be set at any desirable angle and position and can be of variable length and width to adjust and control a desired distribution and direction of suction at the intake port mouth. A suitable number of ribs and pads are employed to properly support the squeegee blade above the bottom wall and provide proper air flow control without undue restrictions. The end pads along with the squeegee blade and intake port bottom wall also define and control end slots for additional sideways air and liquid aspiration which effectively removes liquid and foreign debris from and side borders, radii and the like.

The squeegee blade extends a minimal distance beyond the bottom wall of the intake port towards the cleaning surface. Thus, the high suction pressure, air flow velocity and air flow direction developed within the tool and intake port throat is maintained over the entire bottom surface of the blade without significant dissipation. In this way aspiration is highly effective regardless of the blade's attack angle. Further, liquids and debris are drawn from porous depressions, liquids are prevented from dripping off the blade when removed from the cleaned surface and blade drying occurs preparing the tool for its next cleaning stroke without requiring a secondary drying wipe. By forming the squeegee blade of a predetermined length and stiffness the squeegee blade has minimal deflection in use.

The suction head is so dimensioned that when it is at the preferred angle of attack in relation to the cleaning surface, the squeegee blade tip extends beyond a perpendicular line to the cleaning surface touching the outer most protrusion of the tool. At the same time the blade also extends below a parallel line to the cleaning surface touching the lowest most point of the tool thus preserving an aspiration gap between the bottom wall of the intake port and cleaning surface. A bevel is employed on the leading edges of both the cover and intake port bottom wall to compensate for their dimensional thickness. Multiple standoff ribs or pads are located near the leading edge of the bottom surface of the intake port bottom wall. The suction head is generally narrow in profile having a bottom wall whose outside surface extends at a minimal angle away from the plane of the squeegee blade with a parallel condition preferred.

When the suction head, intake port and squeegee blade are constructed as stated and with the squeegee blade at its preferred attack angle to the cleaning surface, the suction head fits into a typical framed edge at the beginning of a cleaning stroke while the squeegee blade tip extends to the extreme starting edge of the cleaning surface and an aspiration gap between the tool and cleaning surface is established. At the terminal end of a cleaning stroke and again with the squeegee blade at the preferred attack angle, the handle, operator's hand and the bulk of the tool clear typical frames as the intake port and squeegee blade are allowed to travel very close to that frame. Subsequently, the complete tool is conveniently rotated typically 90 degrees, during which the aspiration gap is preserved and the squeegee blade wipes the final short distance of the cleaning surface to the extreme terminating edge. The standoffs ribs on the intake port bottom wall touch the frame and aid in a smooth rotation and prevents a vacuum seal from forming between the bottom wall and the frame. After tool rotation the suction head is oriented on the frame. As the tool is withdrawn from the cleaned surface the frame itself is squeegeed clean.

It is readily recognized the described invention could be conceivably made of one piece construction plus squeegee blade, two pieces with squeegee blade bonded onto or edgewise to the cover or integral cover-squeegee blade or indeed one piece with integral squeegee blade. However, my preferred embodiment is made with three pieces which permits convenient blade replacement, conventional efficient manufacturing techniques and superior selection of materials.

According to my invention, I have provided a new and improved vacuum assisted squeegee attachment tool for use with a wet/dry vacuum cleaner for the removal of both liquids and foreign debris from typically planar surfaces and comprising:

(a) a main body containing a hollow handle connectable to a vacuum source having a handle exit port and intake port at opposite ends thereof,
(b) an enclosed vacuum chamber within said main body assisting in the distribution of suction pressure interposed between the intake port throat and the handle with exit port to a vacuum cleaner and connectively attached to the handle and suction head,
(c) an oblong suction head at one end of said main body with said intake port in said head being perpendicular to a normal direction of use and attached to the vacuum chamber such that the intake port has direct communication with a vacuum source provided by the vacuum cleaner, Other features of my invention relate to the above described tool further having:

(d) a cover mounted on said main body and with a portion of the cover co-acting with the main body intake port,
(e) a squeegee blade mounted on the body, and
(f) integral releasable means on the main body and cover and cooperating to lock the squeegee blade against accidental disassembly from said main body.

Yet other features of my invention concern a short squeegee blade when at 60 degrees to a plane of a cleaned surface, the blade having an extreme bottom surface outer tip which extends beyond a perpendicular line to the cleaning surface touching an outer most point of the tool and also extends below a parallel line to the cleaning surface touching a lowest most point of the tool.

These and other objects and advantages of the invention will become apparent from the following illustrations, descriptions, and claims of a preferred embodiment thereof.

DETAILED DESCRIPTION OF THE DRAWINGS

Figure 1:
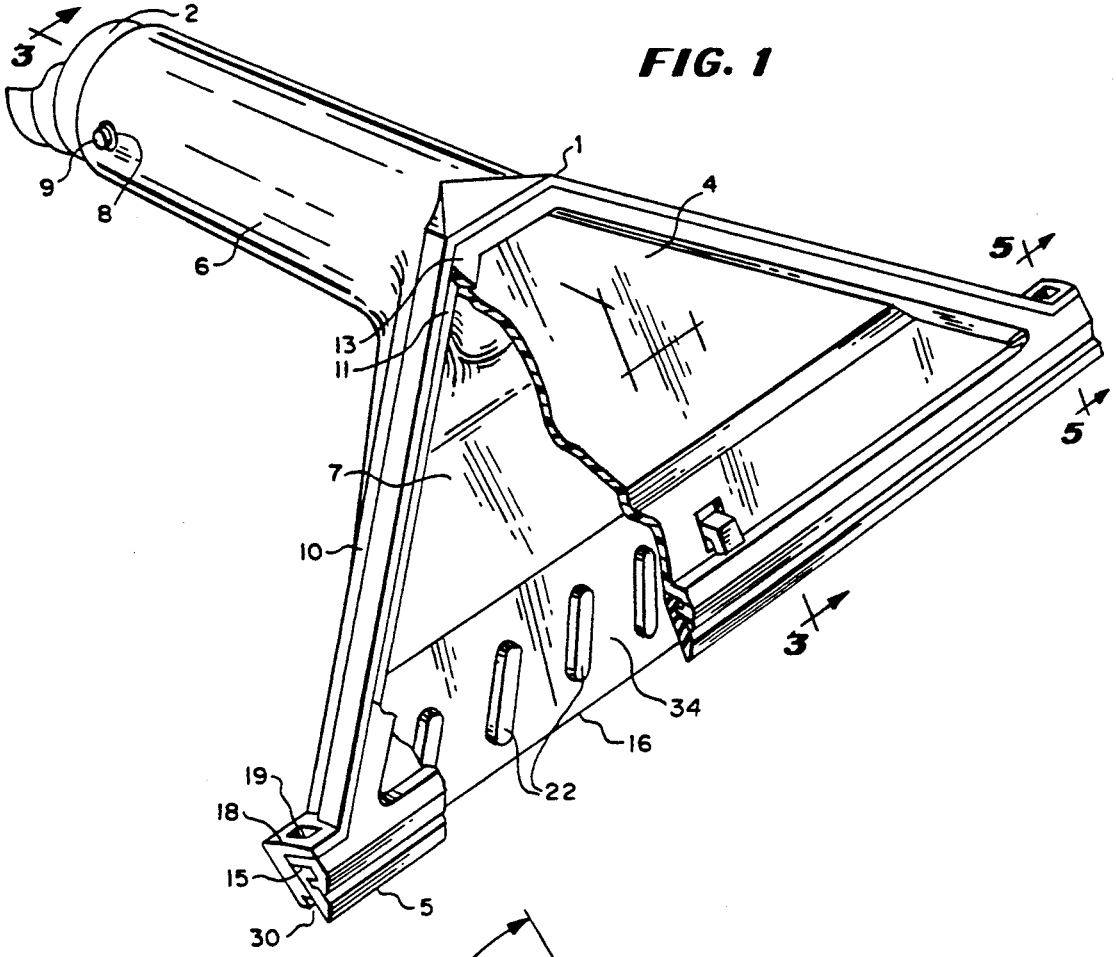
FIG. 1 is an enlarged fragmentary perspective view of my squeegee attachment tool which embodies important features of my invention.

Referring to FIG. 1 a vacuum assisted squeegee attachment tool 1 is connected to a typical wet vacuum cleaner intake extension hose 2 which is in turn connected to the intake port of a source of vacuum accommodating wet pick up, typically a wet/dry vacuum cleaner (not shown). Alternately, typical vacuum cleaner extension wands (not shown) can be inserted between the squeegee attachment tool 1 and the hose 2 for convenience in reaching high windows and for floor applications while standing.

Figure 2:
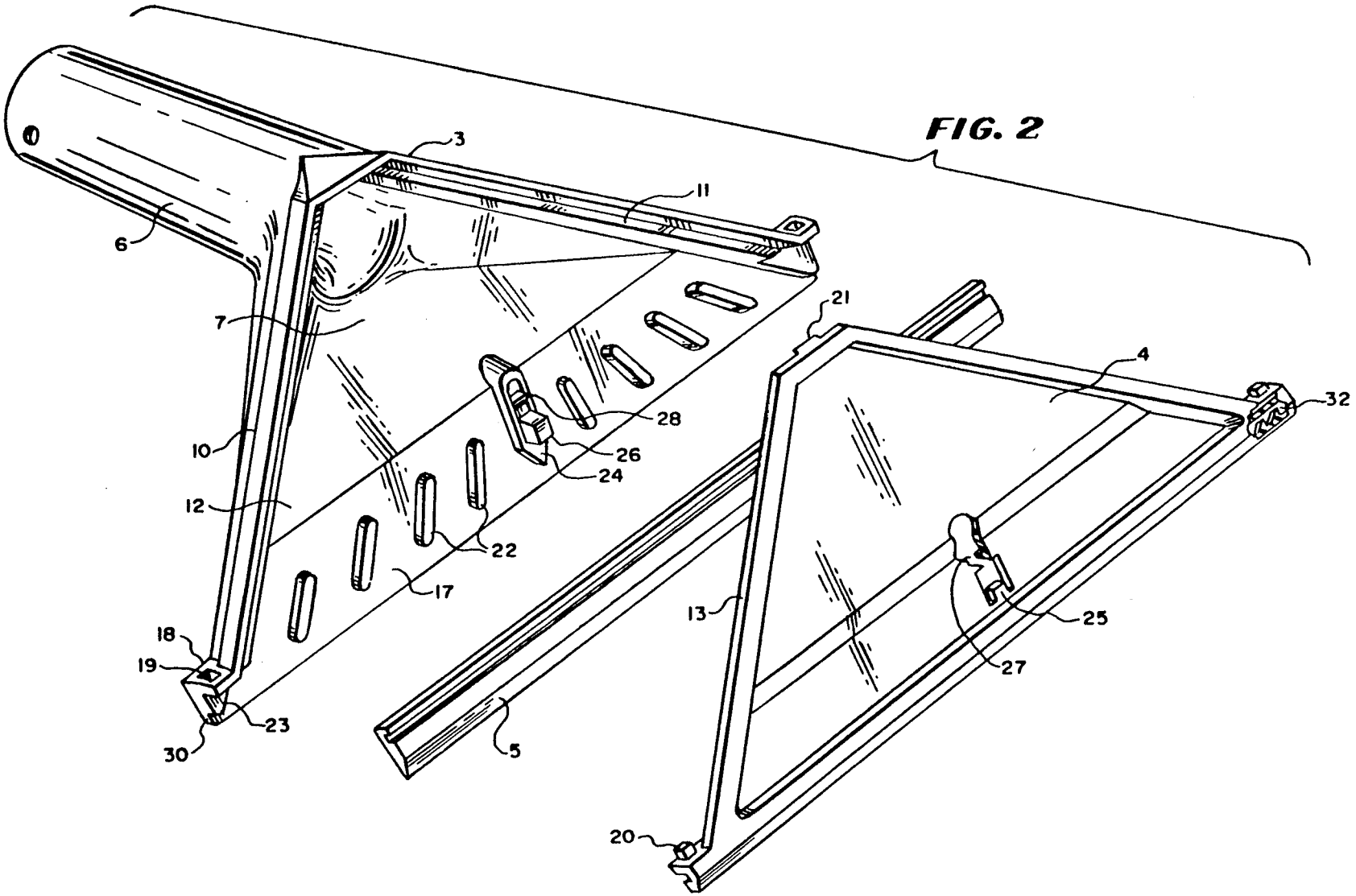
FIG. 2 is an enlarged exploded view of the hand tool shown in FIG. 1.

As shown in FIG. 2, the vacuum assisted squeegee attachment tool 1 is of a three piece construction not requiring additional fastening means. It includes a main body 3, a detachable cover 4 (both preferably molded of plastic), and a squeegee blade 5. The blade 5 is normally made of a resiliently flexible non-absorbent rubber or synthetic rubber-like material.

Figure 3:
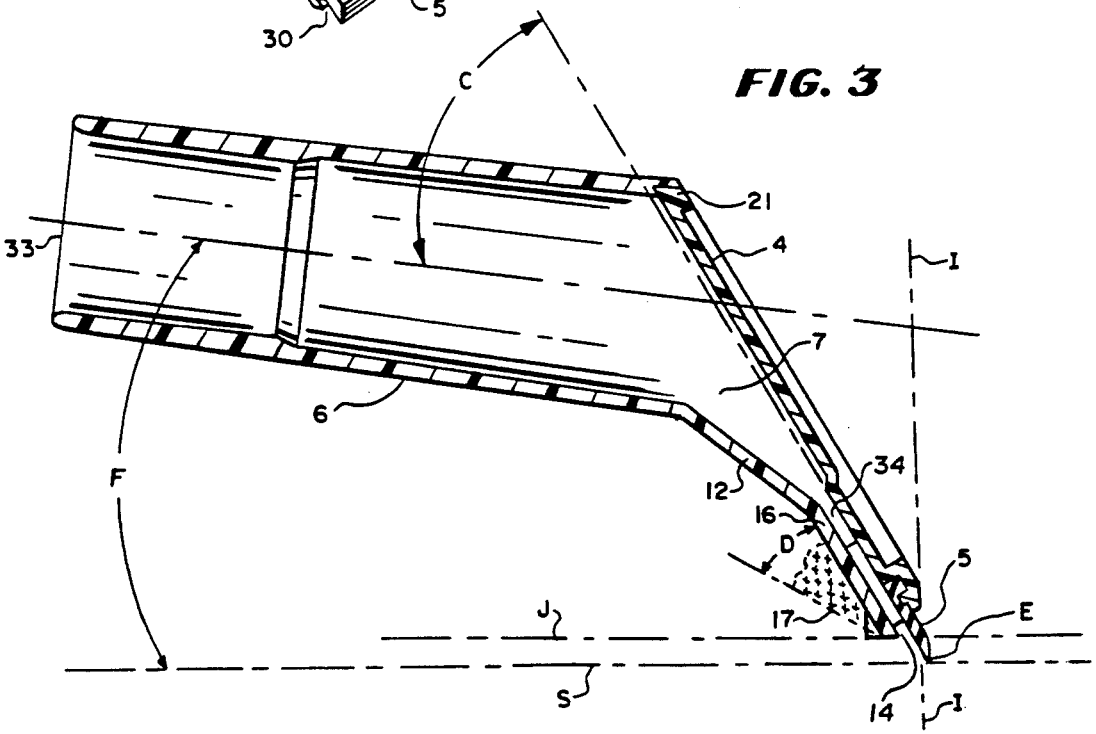
FIG. 3 is an enlarged vertical section taken on the line 3—3 looking in the direction indicated by the arrows as seen in FIG. 1.
Figure 5:
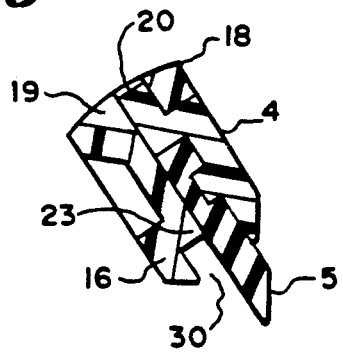
FIG. 5 is an enlarged vertical section taken on the line 5—5 looking in the direction indicated by the arrows as seen in FIG. 1.

Tabs 20 at either end and tab 21 incorporated as part of the cover 4 respectively slide into and intersect slots 19 in the side/back wall extensions 18 of the main body 3, as also shown in FIG. 5, and the inside wall of the handle 6 as seen in FIG. 3 providing solid retention of the cover 4 to the body 3 in the direction of applied pressure when the tool 1 is in use. As required, additional tabs 25 and slots 26 may be incorporated in the cover 4 and main body 3 to afford additional restraint in the middle section. Retaining tab 27 in integral part of cover 4 and stop 28 an integral part of main body 3 securely lock the cover 4 to the main body 3. By the simple deflection of the cover 4 and retaining tab 27 from the under side, the cover 4 is easily removable for blade replacement. Lip 13 on the cover 4 and step 11 of side/back walls 10 mate, support the cover 4 on the main body 3, and form a vacuum seal.

Incorporated as a part of the main body 3 is a continuously tubular hollow handle 6 communicating between the hose 2 and vacuum chamber 7. Connection between the exit port 33 of the handle 6 and extension hose 2 is made through standard vacuum cleaner attachment tool internally tapered friction fit and/or an optional locking hole 8 in the handle 6 and a standard locking tab 9 incorporated within some extension hoses 2 and some extension wands (not shown).

The construction of the tool 1 enables the blade 5 to be used in a highly effective way over a very wide range of working attack angles. It has been discovered by experimentation and measurement that the most efficient relationship of a relatively short squeegee blade 5 to a cleaning surface, dashed line "S", FIG. 4, occurs when said blade is initially set at an oblique angle of between 50 and 70 degrees relative to said cleaning surface with 60 degrees being preferred, angle "A", FIG. 4. It has further been discovered through observation and measurement that a tool of this nature fits most naturally and comfortably in the palm of an operator's hand when the longitudinal center line of the handle or extension wand is at approximately 98 degrees to the centerline of the operator's arm, angle "B", FIG. 6B, with a plus or minus 10 degrees being a most comfortable wrist movement.

Taking advantage of these discoveries and translating them to my tool 1 the longitudinal center line of the handle 6 for models primarily hand held is set in relation to the preferred squeegee blade 5 angle such that when the blade 5 is at its preferred angle the handle then is at predetermined oblique angles in relation to the cleaning surface "S" of between 0 and less than 20 angles, with 8 degrees preferred, angle "F", FIG. 3. Consequently, in this case, then with a blade 5 preferred attack angle of 60 degrees the handle is set at oblique angles in relation to the plane of the squeegee blade of greater than 40 up to 60 degrees with 52 degrees preferred, angle "C", FIG. 3. With these angles the squeegee blade 5 can be caused to be used at the preferred 60 degree angle of attack. As with a handle/blade setting as described an operator can clean a surface with the operator's wrist being used within natural angles thus enabling efficient and comfortable hand-wrist-arm movement throughout a cleaning stroke and eliminates the need for additional stabilizing or controlling means.

Figure 6A:
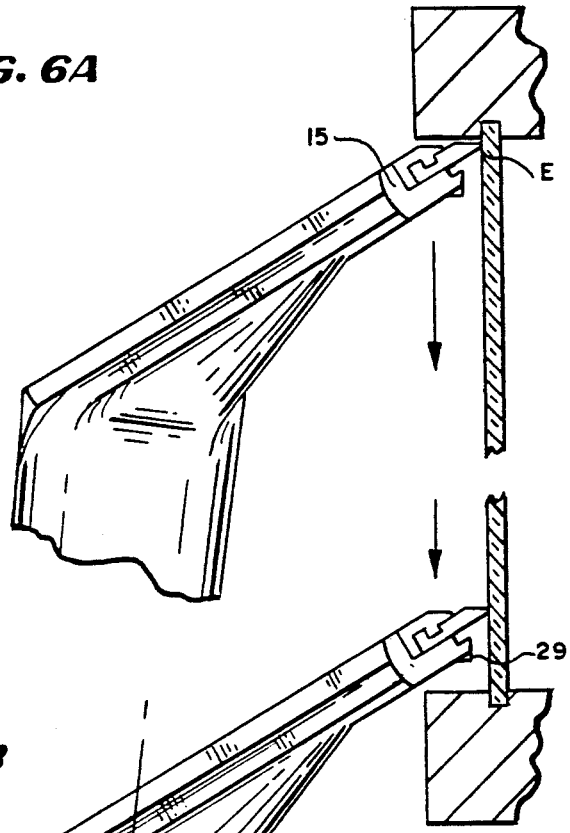
FIG. 6A is an enlarged fragmentary side elevation of my hand tool shown in FIG. 1 and further illustrating the operation of the hand tool when it is used to clean a windowpane.
Figure 6B:
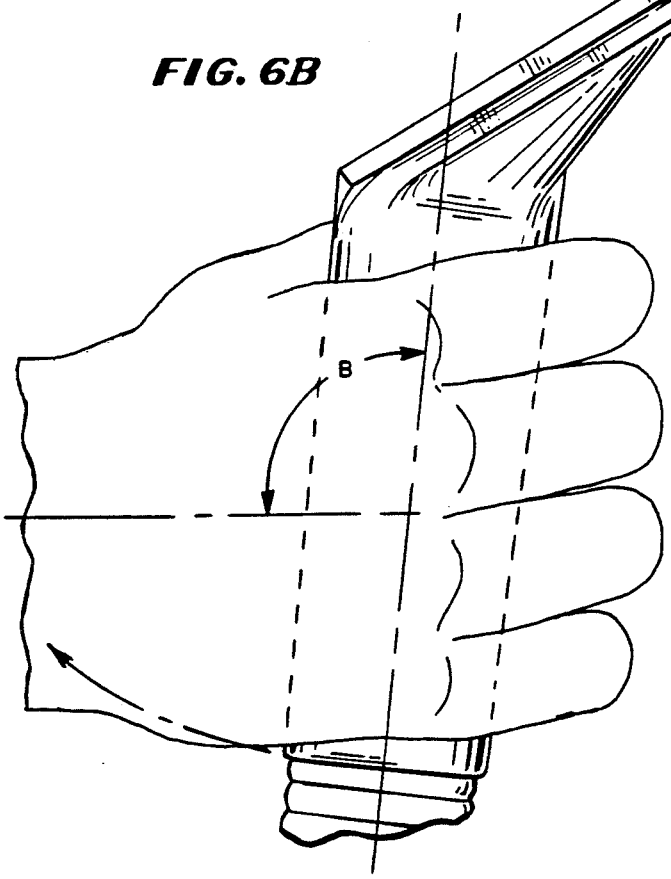
FIG. 6B is an enlarged fragmentary side elevation of the tool shown in FIG. 6A illustrating the way in which the tool is operated when its squeegee blade nears a bottom edge of the windowpane shown in FIG. 6A, 6B and an operator's natural arm/hand angle.

With the tool 1 oriented so that blade 5 is at the preferred angle of attack the vertical distance between the blade tip, point "E", FIG. 3, and the lowest most point of the handle 6 is set at a minimum of 1.25 inches, as represented by dimension "F", in FIG. 3 and FIG. 6A. This dimension allows the handle 6 and operator's hand to clear typical frames at the end of a cleaning stroke as shown in FIG. 6B.

The handle 6 is connectively attached to side/back walls 10 and bottom wall 12. These walls 10 and 12 cooperate together with the cover 4 in defining the vacuum chamber 7 which assists in pressure equalization within the intake port throat 34 and the intake port 14. The vacuum chamber 7 communicates directly between the handle 6 and the intake port throat 34 and intake port 14. As best seen in FIG. 2, the side/back walls 10 are run in essentially a straight line from the point of attachment to the handle 6, and in combination with the end pads 23, incorporated within the intake port throat 34, to approximately the outermost points of the intake port 14. Alternatively, these walls 10 and pads 23 can be formed in an arc such that a convex configuration extends within vacuum chamber 7 which approximates the natural flow of air being drawn into an open unrestricted tube. Bottom wall 12 together with bottom wall 16 within intake port throat 34 also form a convex configuration within the vacuum chamber 7 intake port throat 34 combination, and cover 4 together with the blade 5 are essentially planar. Thus in both conditions stated, typical concave constructions and steps are eliminated providing a highly efficient free flow vacuum chamber 7 and intake port 34 with an unobstructed air flow path devoid of air turbulence and dead air spaces. Hence, uniform suction pressure along the mouth of the intake port 14 and increased side suction pressure at the side slots 30 are promoted.

The vacuum assisted squeegee attachment tool 1 is formed integrally with an oblong suction head 15 of a narrow profile oriented transversely to the normal path of the movement of the tool 1. The suction head 15 has an intake port 14 and intake port throat 34 of a narrow and constant height which runs the full width of the suction head 15. The suction head 15 and intake port 14 are defined by an upper wall that is located as a continuation of the cover 4, a bottom wall 16, is an extension of bottom wall 12 and the squeegee blade 5 each oriented parallel to one another. Intake port 14 and intake port 34 are further defined by ribs 22, pads 23, pad(s) 24 and side/back walls 10 with extensions 18 integral with the bottom wall 16 and underlie the cover 4. The intake port throat 34 is relatively long being defined as 0.500 inches or greater from intake port 14 to vacuum chamber 7 as identified by dimension "G" in FIG. 4. This long intake port throat construction creates a transitional zone between the vacuum chamber 7 and the intake port 14 further promoting pressure equalization along the lateral width of the mouth of the intake port 14 without restricting total air flow because of intake port throat's consistent and uniformed height.

Figure 4:
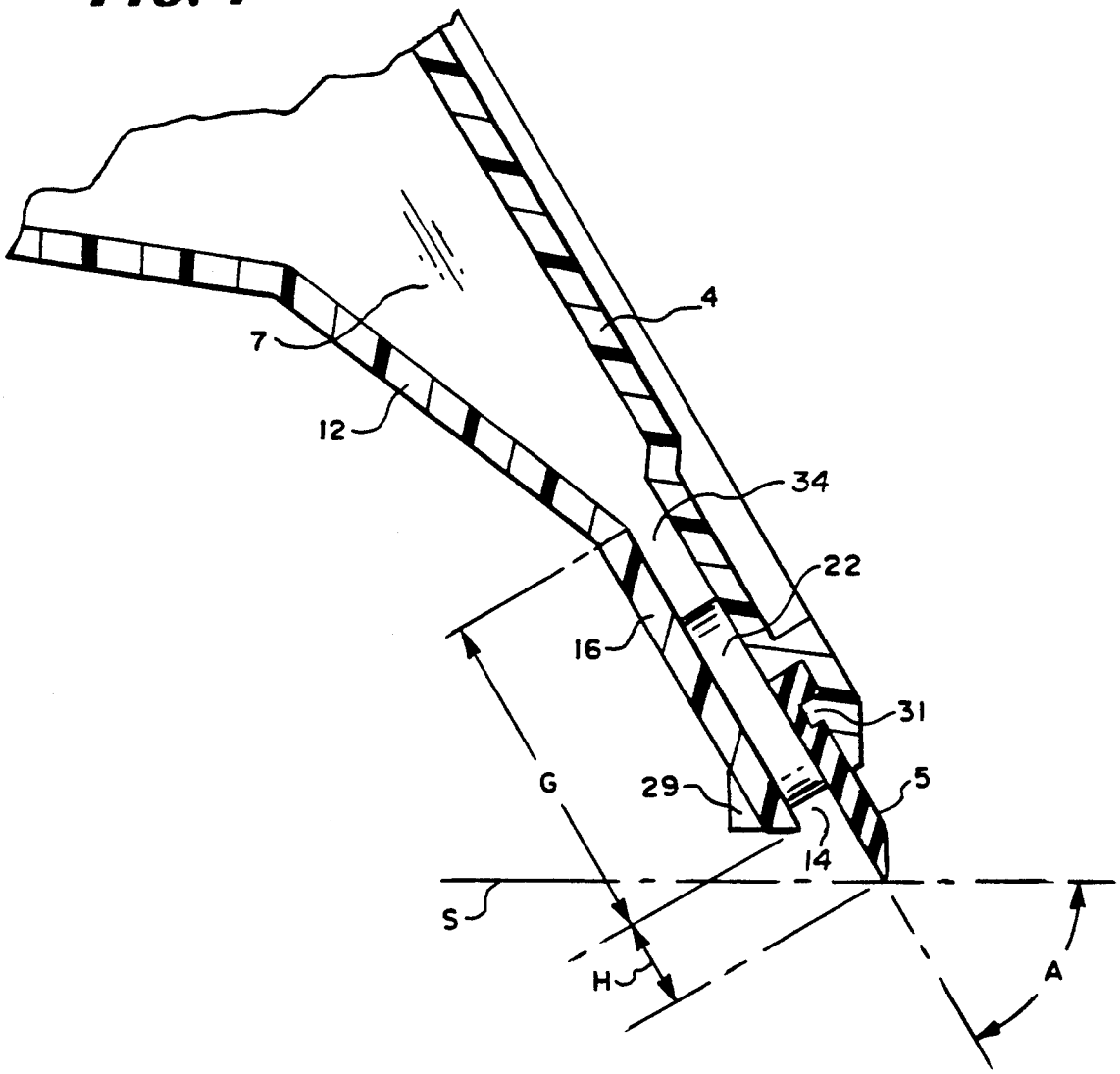
FIG. 4 is an enlarged fragmentary vertical section of portions of the hand tool illustrated in FIG. 3.

As best seen in FIG. 4, the cover 4 is stepped towards its forward edge by an amount essentially equal to the thickness of the back portion of the squeegee blade 5 to prevent the blade 5 from moving rearward into the tool 1. The bottom surface of the blade 5 therefore is flush with the inside surface of the cover 4 providing an unobstructed air flow path devoid of dead air space within the intake port throat 34. Rib 31, a part of cover 4 and oriented parallel to and forming a channel with the stepped portion of the cover 4, matches a complementing groove in the blade 5 preventing the blade 5 from moving forward out of the tool 1. Thus, the blade 5 is retained in an upward direction towards the cover 4 and is prevented from being sucked into or pulled out of the tool 1 and is retained parallel to the cover's 4 leading edge and the mouth of the intake port 14. Saw teeth projections 32, FIG. 2, within the formed channel of cover 4 bite into the squeegee blade 5 providing lateral retention means. The cover 4 extends past rib 31 providing additional support for the blade 5 while in use.

Integrally molded on the top surface of the bottom wall 16 just inside its leading edge and located within the intake port throat 34 are a plurality of flat topped angled ribs 22, end standoff pads 23, and optional center standoff pad(s) 24 as seen in FIG. 2. Together, said ribs and pads support the cover 4 and the blade 5 above the bottom wall 16, retain the squeegee blade 5 within the cover 4, define the height of the intake port 14 intake port throat 34 and work as baffles directing and controlling air flow and suction pressure distribution along the mouth of the intake port 14. Each of the said ribs and pads can be independently set at any desirable angular degree, length, width and shape to effect the desired suction pressure distribution. These rib and pad parameters are best set by trial to compensate for the tool's 1 specific dimensions, configuration, and application. However, preferred orientation is downward towards the intake port 34 and outward from center towards the ends of intake port 14 for the ribs 22 and the end pads 23 to direct suction pressure towards the outer ends of intake port 14. The sides of the center pad 24 are oriented downward and inward minimizing blockage. In this way, the high concentration of suction pressure normally found at the center of vacuum cleaner attachment tools is redirected towards the outer end. Thus, uniform pressure is provided along the mouth of the intake port 14 which increases side suction pressure at end slots 30. The number of ribs and pads is defined by the minimum number required to adequately support the cover 4 and the squeegee blade 5 while providing adequate air flow control without undue restrictions.

My tool 1 achieves an increased air flow velocity and therefore increased suction pressure and efficiency for aspirating liquids at the mouth of the intake port 14 by maintaining the total intake port area (intake port 14 height perpendicular to the bottom wall 16 times total length) at less than the total cross sectional area of the vacuum intake system designed for the vacuum source as generally identified by the vacuum hose 2 and defined by the exit port 33 of the handle 6 of tool 1. However, the total intake port area must be maintained sufficient enough to avoid undue stress and early failure of the vacuum source and to avoid unnecessary clogging of the intake port 14 by foreign debris. It has been discovered through experimentation and measurement that for maximum efficiency the total area of the intake port 14 should be less than 80 percent but greater than 25 percent of the cross sectional area of the exit port 33 of the handle 6. For an eight (8) inch squeegee blade, I have found that sixty (60) percent is preferred for the total area of the intake port 14.

End slots 30, formed between the blade 5 and the bottom wall 16 by end standoff pads 23, provide additional side directed suction effectively drawing liquid and debris from the surface of and even from under framing and other obstructions along the side edges of a squeegeed surface.

The squeegee blade 5 runs laterally the full width of suction head 15 and intake port 14 but extends less than ¼ inch less but greater than 0.075 inches beyond the intake port bottom wall 16 towards cleaning surface S as indicated by dimension "H" in FIG. 4. Thus, the high suction pressure and air flow velocity created at intake port 14 is not seriously dissipated over this short distance and high efficiency is maintained in actual use regardless of the attack angle of the squeegee blade 5. The resulting continuous high air flow rate over the entire bottom surface of the blade 5 eliminates dripping of liquids when it is removed from the squeegeed surface and the blade 5 is quickly dried preparing it for immediate reuse without requiring a secondary drying wipe. By providing a relatively short blade length, the blade 5 is relatively stiff so as to minimize deflection in use. The short blade 5 in combination with the wide degree of effective working attack angles eliminates the need for additional stabilizing or controlling means and further prevents the blade 5 from folding over onto itself during rotation of the tool 1 at the end of a cleaning stroke as further explained below.

Referring to FIG. 3, the suction head 15 is specifically dimensioned in relation to the squeegee blade 5 so that when blade 5 is at its preferred angle of attack to reference cleaning surface line "S" the tip of the blade 5, at point "E", extends outside a perpendicular line from cleaning surface "S" indicated by dashed line "I" which touches the outermost protrusion of the cover 4. At the same time point "E" also extends below a parallel line to cleaning surface "S", dashed line "J", touching the lowest most point of the bottom wall 16. Point "E" extends past these two lines, "I" and "J", because the leading edges of both the cover 4 and the bottom wall 16 are beveled which compensates for their dimensional thickness. As indicated by angle "D", the bottom surface 17 of the bottom wall 16 is maintained at an oblique angle of 15 degrees or less in relation to the plane of the blade 5, 0 degrees being preferred. The shallow nature of angle "D" thus enables the intake port 14 and the blade 5 to travel very close to a typical framed terminal edge of a cleaned surface while the blade 5 is at the preferred angle of attack as seen in FIG. 6B.

Figure 7:
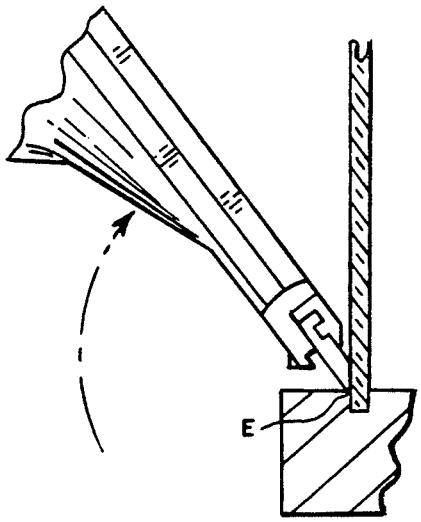
FIG. 7 is an enlarged fragmentary view of my hand tool illustrating the way in which the hand tool is rotated at the end of a cleaning stroke cleaning both the cleaning surface terminating edge and the window frame shown in FIG. 6B.

Thus, in combination then and with the squeegee blade 5 at the preferred attack angle to the cleaning surface, the foregoing specific configuration allows the suction head 15 to fit into the framed edge at the beginning of a cleaning stroke, as seen in FIG. 6A. The squeegee blade tip, point "E", now extends to the extreme starting edge of the cleaning surface while an aspiration gap between the bottom wall 16 and the cleaning surface is preserved. Towards the end of a typical cleaning stroke, as seen in FIG. 6B, the handle 6, the operator's hand and bulk of the tool 1 clear the typical framed edge. Because of the narrow angle of bottom surface 17 in relation to the squeegee blade 5 the intake port 14 and the blade 5 are allowed to travel very close to the terminal edge of the cleaned surface while the blade 5 continues to remain at the preferred angle. As bottom surface 17 touches the frame the complete tool 1 is rotated 90 degrees by the operator as indicated in FIG. 7. As rotation of the tool 1 proceeds standoff ribs 29 contact the frame before bottom surface 17 becomes parallel to the frame's side wall. The standoff ribs 29 thus prevent a vacuum seal from forming by maintaining an aspiration gap between the bottom surface 17 and the frame and additionally provides a pivot point aiding in a smooth efficient rotation of the tool 1. Throughout the rotation of the tool 1 the blade 5 is maintained in continuous contact with the cleaning surface wiping the last short distance to the exteme terminating edge and an aspiration gap is continuously maintained between the bottom wall 16 and the cleaned surface and/or frame. The suction head 15 and the squeegee blade 5 now fit into this final bordered edge as at the beginning of the cleaning stroke but now oriented on the frame instead of the cleaned surface. The bordering frame itself can now also be squeegeed cleaned.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A vacuum assisted squeegee attachment tool for use with a wet/dry vacuum cleaner for the removal of both liquids and foreign debris from typically planar surfaces and comprising:

(a) a main body containing a hollow handle connectable to a vacuum source having a handle exit port and an intake port throat at opposite ends thereof, (b) an enclosed vacuum chamber within said main body assisting in the distribution of suction pressure interposed between the intake port throat and the handle exit port to a vacuum cleaner, (c) an oblong suction head at one end of said main body, said oblong suction head with said intake port throat in said head being perpendicular to a normal direction of use and connectively attached to the vacuum chamber such that the intake port throat has direct communication with a vacuum source provided by the vacuum cleaner, (d) a cover mounted on said main body in sealed engagement therewith, an inside cover wall comprising part of said vacuum chamber, (e) releasable attachment means joining the cover in removable assembly with said main body and (f) a squeegee blade held in place between the cover and the main body and having a blade tip positioned exteriorly of said oblong suction head for engaging a surface to be wiped by the squeegee blade.

2. A squeegee tool as defined in claim 1 wherein the intake port an intake port bottom wall, said squeegee blade extending greater than 0.075 inches but not greater than ¼ inch beyond said intake port bottom wall.

3. A squeegee attachment tool as defined in claim 2 wherein the squeegee blade is at 60 degrees to a plane of a cleaned surface, said blade having an extreme bottom surface outer tip which extends outside a perpendicular line from the cleaned surface touching an outer most point of the tool and also extends outside a parallel line to the cleaned surface touching a lowest most point of the tool.

4. A squeegee tool as defined in claim 2 with (a) the intake port throat having a mouth of total area less than 80 percent but greater than 25 percent of the cross sectional area of the handle exit port, (b) the intake port throat extending at essentially the same height as the intake port mouth rearwardly into the main body at least 0.500 inches behind the intake port mouth, (c) the intake port bottom wall having an outer surface which is 15 degrees or less to the plane of the squeegee blade.

5. A squeegee tool as defined in claim 2 wherein angled ribs and pads are provided within the intake port throat for controlling and directing air flow and suction pressure distribution, said angled ribs and pads also providing means to support the squeegee blade, and means to support the cover from an underside thereof.

6. A squeegee tool as defined in claim 2 wherein a center axis of said handle is manually set at between 0 and less than 20 degrees in relation to the plane of a cleaning surface when said tool is positioned at its designed, intended and preferred working angle.

7. A squeegee tool as defined in claim 1 further having side slots at each end of and continuous with the intake port throat.

8. A squeegee tool as defined in claim 1 where the vacuum chamber is provided with outwardly extending walls extended from the handle to the ends of the intake port, and the space defined by said outwardly extending walls and said main body and cover being free of dead air pockets so to obtain more uniform efficient air flow through the vacuum chamber.

9. A squeegee tool as defined in claim 1 wherein said suction head has a series of transversely spaced ribs extending away from said oblong suction head and providing means for spacing said oblong suction head away from a planar surface border thus enabling an air gap to be maintained between said suction head and said border.

10. The squeegee tool as defined in claim 1 wherein said squeegee blade is mounted on said oblong suction head, the intake port throat ending in a bottom wall, said squeegee blade extending greater than 0.075 inches but not greater than ¼ inch beyond said bottom wall.

11. The squeegee tool as defined in claim 10 wherein the suction head has a bottom wall whose leading edge is bevelled.

12. A vacuum assisted squeegee attachment tool for use with a wet/dry vacuum cleaner for the removal of both liquids and foreign debris from typically planar surfaces and comprising:

(a) a main body containing a hollow handle connectable to a vacuum source having a handle exit port, said main body having an intake port, said handle exit port and said intake port being at opposite ends, (b) an enclosed vacuum chamber within said main body assisting in the distribution of suction pressure interposed between the intake port and the handle exit port to a vacuum cleaner connectively attached to the handle, (c) an oblong suction head at one end of said main body with said intake port in said head being perpendicular to a normal direction of use and connectively attached to the vacuum chamber such that the intake port has direct communication with a vacuum source provided by the vacuum cleaner, (d) a cover mounted on said main body and with a portion of the cover co-acting with the main body forming the suction head intake port, (e) a squeegee blade mounted between said cover and said main body, and (f) releasable means on the main body and cover and cooperating to lock the squeegee blade against accidental disassembly from said suction head.

13. A squeegee tool as defined in claim 12 with the intake port including an intake port bottom wall, said squeegee blade greater than 0.075 but not greater than ¼ inch beyond said intake port bottom wall.

14. A squeegee attachment tool as defined in claim 12 wherein when the squeegee blade is held at a desired position at 60 degrees to a plane of a cleaned surface, said blade then has an extreme bottom surface outer tip which extends outside a perpendicular line from the cleaned surface touching an outer most point of the tool and also extends outside a parallel line to the cleaned surface touching a lowest most point of the tool.

15. A squeegee tool as defined in claim 12 with (a) the intake port throat having a mouth of total area less than 80 percent but greater than 25 percent of the cross sectional area of the handle exit port, (b) the intake port throat extending at essentially the same height as the intake port mouth rearwardly into the main body at least 0.500 inches or more behind the intake port mouth, (c) the intake port bottom wall having an outer surface which is 15 degrees or less to the plane of the squeegee blade.

16. A squeegee tool as defined in claim 12 wherein said releasible means secures the cover over said top surface of said main body, angled spaced ribs positioned on said main body within the intake port which (1) control and direct air flow and suction pressure distribution into said port, (2) said spaced ribs engaging against said squeegee blade to support the squeegee blade, and (3) said ribs also providing supports for the cover from its underside.

17. A squeegee tool as defined in claim 1 where the vacuum chamber has walls extending from the handle to essentially an outer most point of the tool, said walls being free of concave forms and being smooth and uninterrupted avoiding dead air pockets generating air turbulence causing obstructions.

18. A vacuum assisted squeegee attachment tool for use with a wet/dry vacuum cleaner for the removal of both liquids and foreign debris from typically planar surfaces and comprising:

(a) a main body containing a hollow handle connectable to a vacuum source having a handle exit port and intake port at opposite ends thereof, (b) an enclosed vacuum chamber within said main body assisting in the distribution of suction pressure interposed between the intake port throat and the handle exit port to a vacuum cleaner and connectively attached to the handle and suction head, (c) an oblong suction head at one end of said main body with said intake port in said head being perpendicular to a normal direction of use and connectively attached to the vacuum chamber such that the intake port has direct communication with a vacuum source provided by the vacuum cleaner, (d) a squeegee blade held in place on the main body and having a blade tip positioned exteriorly of said oblong suction head for engaging a surface to be wiped by the squeegee blade, (c) angled ribs and pads are provided within the intake port throat for controlling and directing air flow and suction pressure distribution, said angled ribs and pads also providing means to support the squeegee blade, and (d) a cover overlying but spaced from said angled ribs and pads, the squeegee blade being held in place between the cover and the main body, and means comprising said ribs and pads supporting the cover from an underside thereof on said main body.

19. A vacuum assisted squeegee attachment tool for use with a wet/dry vacuum cleaner for the removal of both liquids and foreign debris from typically planar surfaces and comprising:

(a) a main body containing a hollow handle connectable to a vacuum source having a handle exit port and intake port at opposite ends thereof, (b) an enclosed vacuum chamber within said main body assisting in the distribution of suction pressure interposed between the intake port and the handle exit port to a vacuum cleaner and connectively attached to the handle and suction head, and (c) an oblong suction head at one end of said main body with said intake port in said head being perpendicular to a normal direction of use and connectively attached to the vacuum chamber such that the intake port has direct communication with a vacuum source provided by the vacuum cleaner, said suction head has a series of transversely spaced ribs extending away from said oblong suction head and providing means for spacing said oblong suction head away from the border of a planar surface being cleaned thus enabling an air gap to be maintained between said suction head and said border.

20. A vacuum assisted squeegee attachment tool for use with a wet/dry vacuum cleaner for the removal of both liquids and foreign debris from typically planar surfaces and comprising:

(a) a main body containing a hollow handle connectable to a vacuum source having a handle exit port and intake port at opposite ends thereof, (b) an enclosed vacuum chamber within said main body assisting in the distribution of suction pressure interposed between the intake port and the handle exit port to a vacuum cleaner and connectively attached to the handle and suction head, (c) an oblong suction head at one end of said main body with said intake port in said head being perpendicular to a normal direction of use and connectively attached to the vacuum chamber such that the intake port has direct communication with a vacuum source provided by the vacuum cleaner, and (d) a squeegee blade mounted between said cover and said main body, and the squeegee blade when held at a desired position, is at 60 degrees to a plane of a cleaned surface, said blade then has an extreme bottom surface outer tip which extends outside beyond a perpendicular line from the cleaned surface touching an outer most point of the tool and also extends outside a parallel line to the cleaned surface touching a lowest most point of the tool.

21. A vacuum assisted squeegee attachment tool for use with a wet/dry vacuum cleaner for the removal of both liquids and foreign debris from typically planar surfaces and comprising:

(a) a main body containing a hollow handle connectable to a vacuum source having a handle exit port and intake port at opposite ends thereof, (b) an enclosed vacuum chamber within said main body assisting in the distribution of suction pressure interposed between the intake port and the handle exit port to a vacuum cleaner connectively attached to the handle and suction head, (c) an oblong suction head at one end of said main body with said intake port being in said head and being perpendicular to a normal direction of use and connectively attached to the vacuum chamber such that the intake port has direct communication with a vacuum source provided by the vacuum cleaner, the suction head having a squeegee blade mounted in proximity to the inlet port, (d) the intake port having a mouth of total area less than 80 percent but greater than 25 percent of the cross sectional area of the handle exit port, (e) the intake port and the intake port mouth extending at essentially the same height rearwardly into the main body at least 0.500 inches behind the intake port mouth, (f) the oblong suction head having an intake port bottom wall said intake port bottom wall having an outer surface which is angled 15 degrees or less to the plane of the squeegee blade.

* * * * *